US008151746B2

(12) United States Patent
Simpson

(10) Patent No.: US 8,151,746 B2
(45) Date of Patent: Apr. 10, 2012

(54) CONTROL SYSTEM FOR A VARIABLE COMPRESSION ENGINE

(75) Inventor: Roger T. Simpson, Ithaca, NY (US)

(73) Assignee: BorgWarner Inc., Auburn Hills, MT (US)

( * ) Notice: Subject to any disclaimer, the term of this patent is extended or adjusted under 35 U.S.C. 154(b) by 520 days.

(21) Appl. No.: 12/304,585

(22) PCT Filed: Jul. 6, 2007

(86) PCT No.: PCT/US2007/072887

§ 371 (c)(1),
(2), (4) Date: Jun. 25, 2009

(87) PCT Pub. No.: WO2008/006042

PCT Pub. Date: Jan. 10, 2008

(65) Prior Publication Data

US 2009/0320803 A1 Dec. 31, 2009

Related U.S. Application Data

(60) Provisional application No. 60/819,103, filed on Jul. 7, 2006.

(51) Int. Cl.
*F02B 75/04* (2006.01)

(52) U.S. Cl. ..... 123/48 B; 123/78 BA; 123/78 F

(58) Field of Classification Search ..... 123/4 B, 123/78 BA, 78 F

See application file for complete search history.

(56) References Cited

U.S. PATENT DOCUMENTS

| | | | |
|---|---|---|---|
| 5,172,659 | A | 12/1992 | Butterfield |
| 6,354,252 | B1 | 3/2002 | Rabhi |
| 7,000,580 | B1 | 2/2006 | Smith |
| 2004/0182344 | A1 | 9/2004 | Simpson |

FOREIGN PATENT DOCUMENTS

| | | |
|---|---|---|
| GB | 1206869 | 9/1970 |
| JP | 09254895 | 9/1997 |
| WO | 2005098219 | 10/2005 |

OTHER PUBLICATIONS

PCT search report and written opinion for PCT/US2007/072887 mailed Nov. 30, 2007; 13 pgs.

*Primary Examiner* — Noah Kamen
(74) *Attorney, Agent, or Firm* — Brown & Michaels, PC

(57) ABSTRACT

A control system for an adjustment device for a variable compression ratio engine comprising: a jack head, a jack piston, a sprocket wheel, a movable transmission member, and a control valve. The jack piston is received within a chamber of the jack head defining first and second fluid chambers. The control valve controls the flow of fluid between the first and second fluid chambers. Based on the position of the control valve, fluid flows from the first fluid chamber to the second fluid chamber or vice versa, moving the control rack connecting the jack piston to the sprocket wheel. Reciprocating motion of the sprocket wheel adjusts the position of the cylinder of the engine.

12 Claims, 6 Drawing Sheets

CONTROL SYSTEM FOR A VARIABLE COMPRESSION ENGINE

REFERENCE TO RELATED APPLICATIONS

This application claims one or more inventions which were disclosed in Provisional Application No. 60/819,103,, filed Jul. 7, 2006,, entitled "CONTROL METHOD FOR A VARIABLE COMPRESSION ACTUATOR SYSTEM". The benefit under 35, USC §119(e) of the U.S. provisional application is hereby claimed, and the aforementioned application is hereby incorporated herein by reference.

BACKGROUND OF THE INVENTION

1. Field of the Invention

The invention pertains to the field of variable compression actuator systems. More particularly, the invention pertains to a control method for a variable compression actuator system.

2. Description of Related Art

Prior art FIGS. 1 and 2 show an adjustment device for a variable compression ratio engine as disclosed in WO 2005/098219. The engine block 100 has as at least one cylinder in which a piston 2 moves by means of a transmission device 1.

The transmission device 1 has a transmission member 3 integral with piston 2 and cooperating on one side with a rolling guide device 4 and a sprocket wheel 5 on the other side. The sprocket wheel 5 is connected to a connecting rod 6 jointed to crankshaft 9 to determine the transmission of movement between the piston 2 and the crankshaft 9.

The sprocket wheel 5 cooperates on the opposite side of the transmission member 3 with a control rack 7. The vertical position of the control rack 7 in relation to the engine block 100 is guided by a control device 12. The control device has a control jack 8 of which its jack piston 13 is guided into a jack cylinder 112 set into the engine block 100. The jack cylinder 112 is bored or fitted into the engine block 100. The jack cylinder 112 is secured in an upper part by a jack head 113 that is screwed into the engine block 100.

The sprocket wheel 5 has a first set of serrations 52 for engaging the serrations 74 of the control rack 7 and a second set of teeth 51 on an opposite side of the sprocket wheel 5 for engaging a first rack of the transmission member 3 with corresponding teeth. Opposite the first rack of the transmission member 3 is another rack 37 with teeth that cooperate with a roller 40 of a rolling guide device 4 integral with the engine block 100. The engine block 100 on the side of a cylinder 110 has a support 41 with racks 46 allowing synchronization of the displacement of the roller 40 with the piston 2.

The jack piston 13 divides a chamber formed between the jack head 113 and control rack 7 in which the control device 12 is received into an upper chamber 121 and a lower chamber 122. Movement of the jack piston 13 is further controlled by a control rod 20 which is received within a bore of the jack piston 13 along with the lower jack rod 16. The control rod 20 limits the movement of the jack piston 13 between two springs 22 and loaded stops 130. The limited movement of the control rod 20, and thus the jack piston 13 is sufficient to allow the jack piston 13 to pivot slightly, so that the control rack 7 may position itself with in the engine block 100 and align the teeth 74 of the rack 7 with the teeth 52 of the sprocket wheel 5.

The adjustment of the engine's effective compression ratio is achieved by modifying the original position of the stroke of the piston 2 in relation to the cylinder 110 by sprocket wheel 5, mounted freely at the top end of a connection rod 6, a transmission member 3, integral with the piston 13 and a control rack 7, in which the position is regulated by the control device 12.

The present invention provides an alternate control system for the adjustment device disclosed in WO 2005/098219,, which provides a quicker response.

SUMMARY OF THE INVENTION

A control system for an adjustment device for a variable compression ratio engine comprising: a jack head, a jack piston, a sprocket wheel, a movable transmission member, and a control valve. The jack piston is received within a chamber of the jack head defining first and second fluid chambers. The control valve controls the flow of fluid between the first and second fluid chambers. Based on the position of the control valve, fluid flows from the first fluid chamber to the second fluid chamber or vice versa, moving the control rack connecting the jack piston to the sprocket wheel. Reciprocating motion of the sprocket wheel adjusts the position of the cylinder of the engine.

While torque actuation is provided as an example, other types of actuation through the control valve may be used. In using oil pressure actuation, the control valve controls the flow of fluid to and from the first and second fluid chambers and based on the position of the control valve, fluid flows from the first fluid chamber to sump and from supply to the second fluid chamber or vice versa.

DETAILED DESCRIPTION OF THE INVENTION

Figure 1:
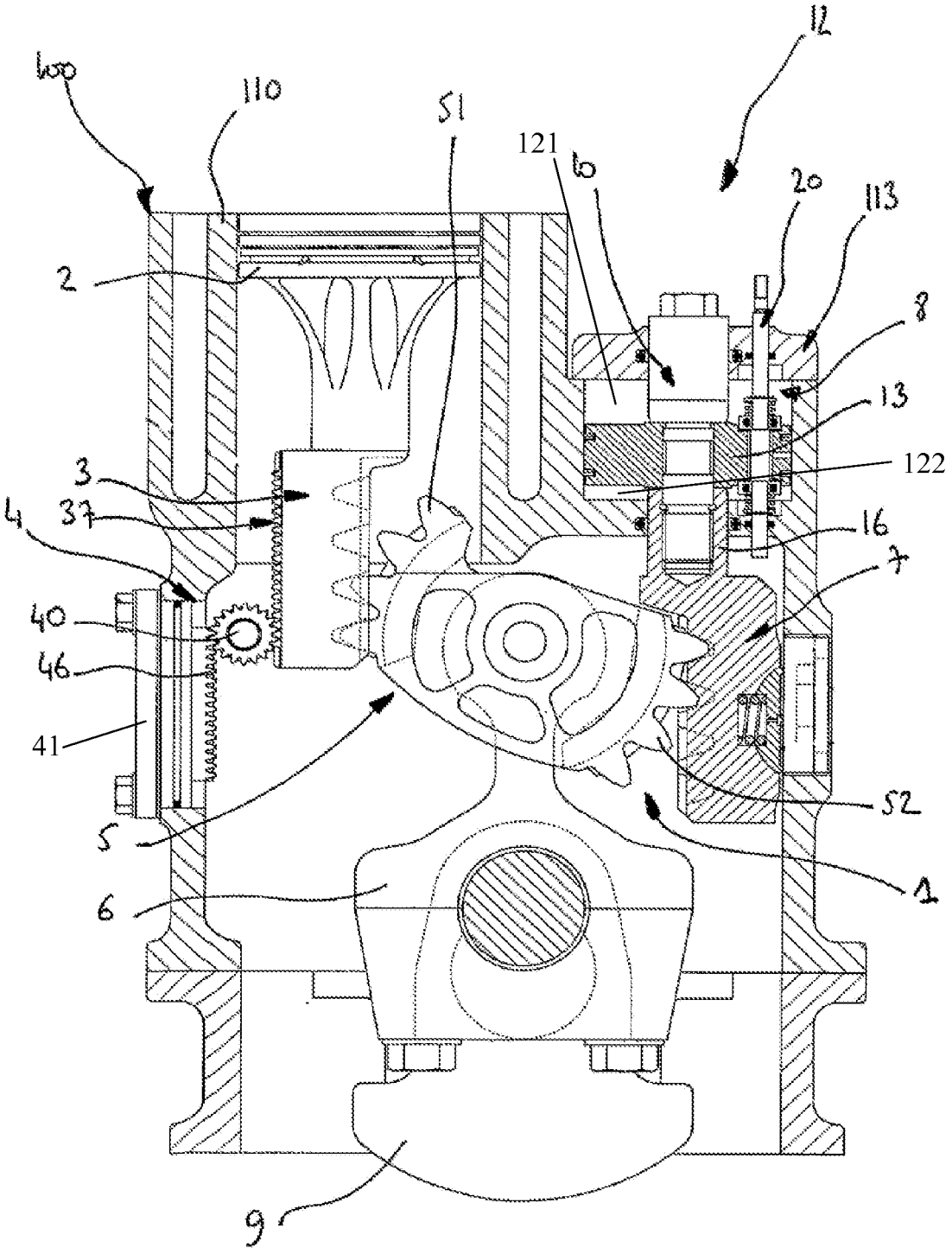
Fig. 1 PRIOR ART
FIG. 1 shows a schematic of an adjustment device of the prior art for a variable compression ratio engine.
Figure 2:
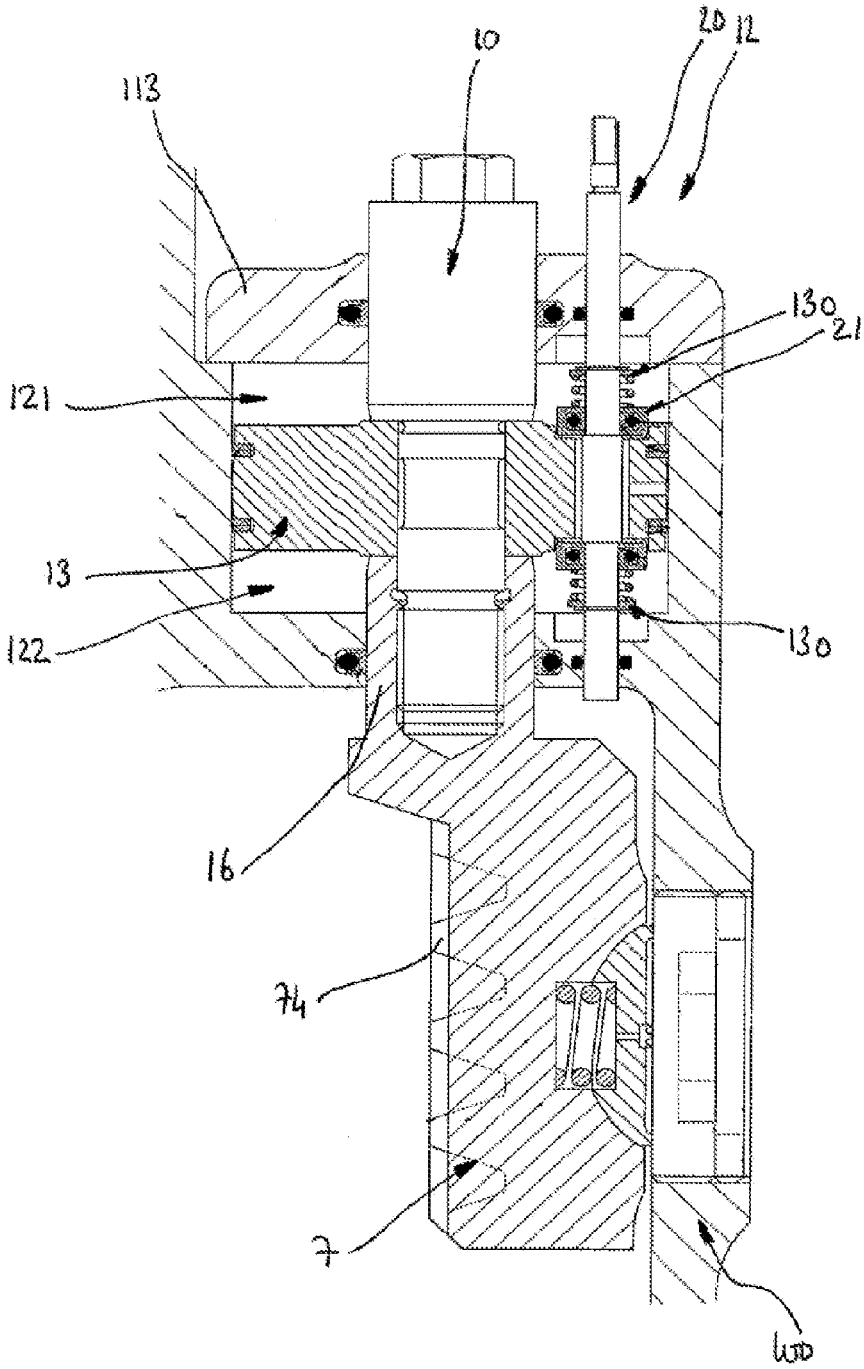
Fig. 2 PRIOR ART
FIG. 2 shows another schematic of the prior art adjustment device.

The control system of the present invention replaces the control device 12 disclosed in WO 2005/098219. The control rod 20, valve 21, stops 130, and springs 22 are removed the adjustment device.

In the control system of the present invention, recirculation of oil is controlled by a spool valve located outside of the control jack 8 but within the jack head 113.

Figure 3:
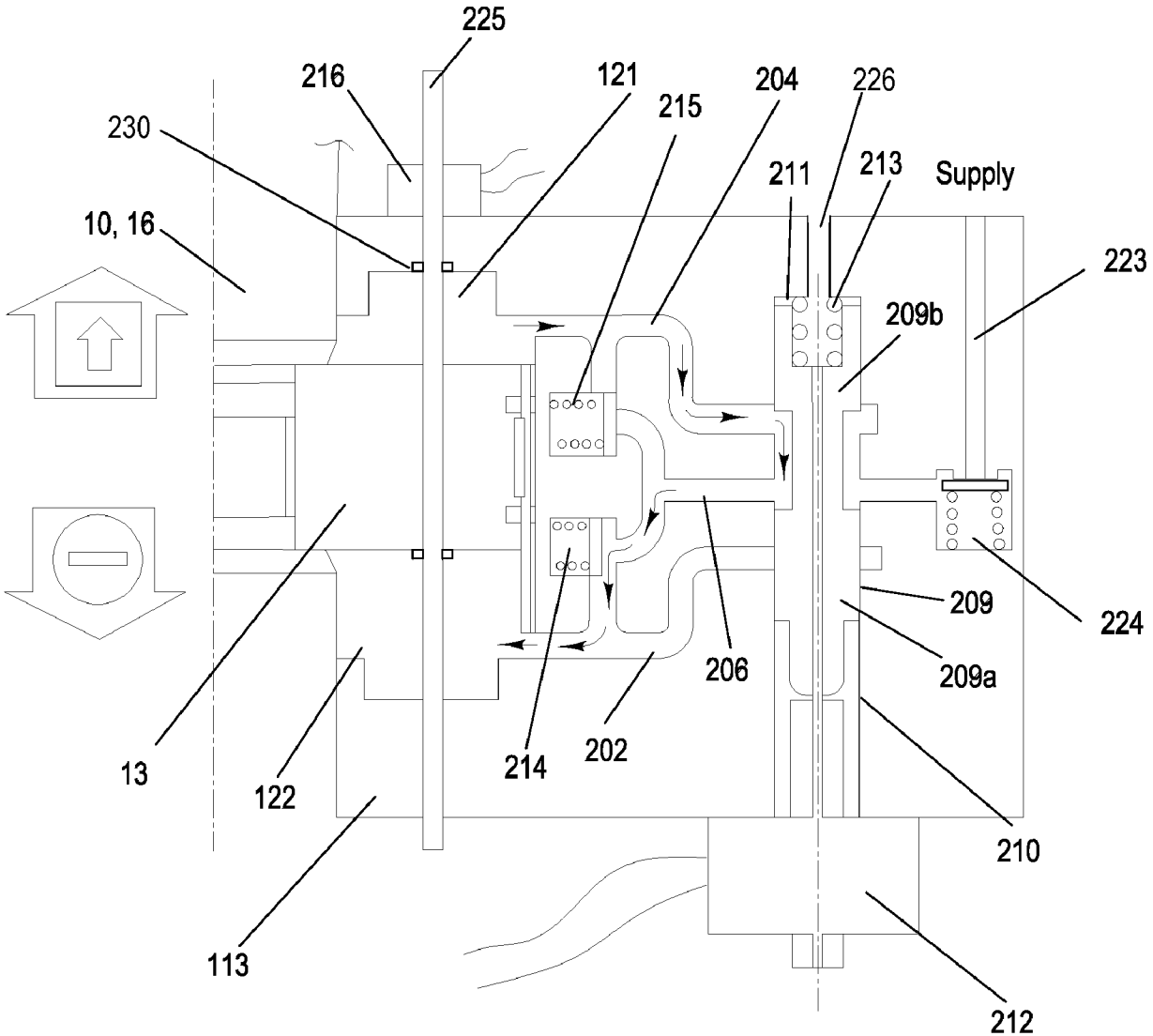
FIG. 3 shows a schematic of the control system of the present invention with the jack piston moving to a first position.
Figure 4:
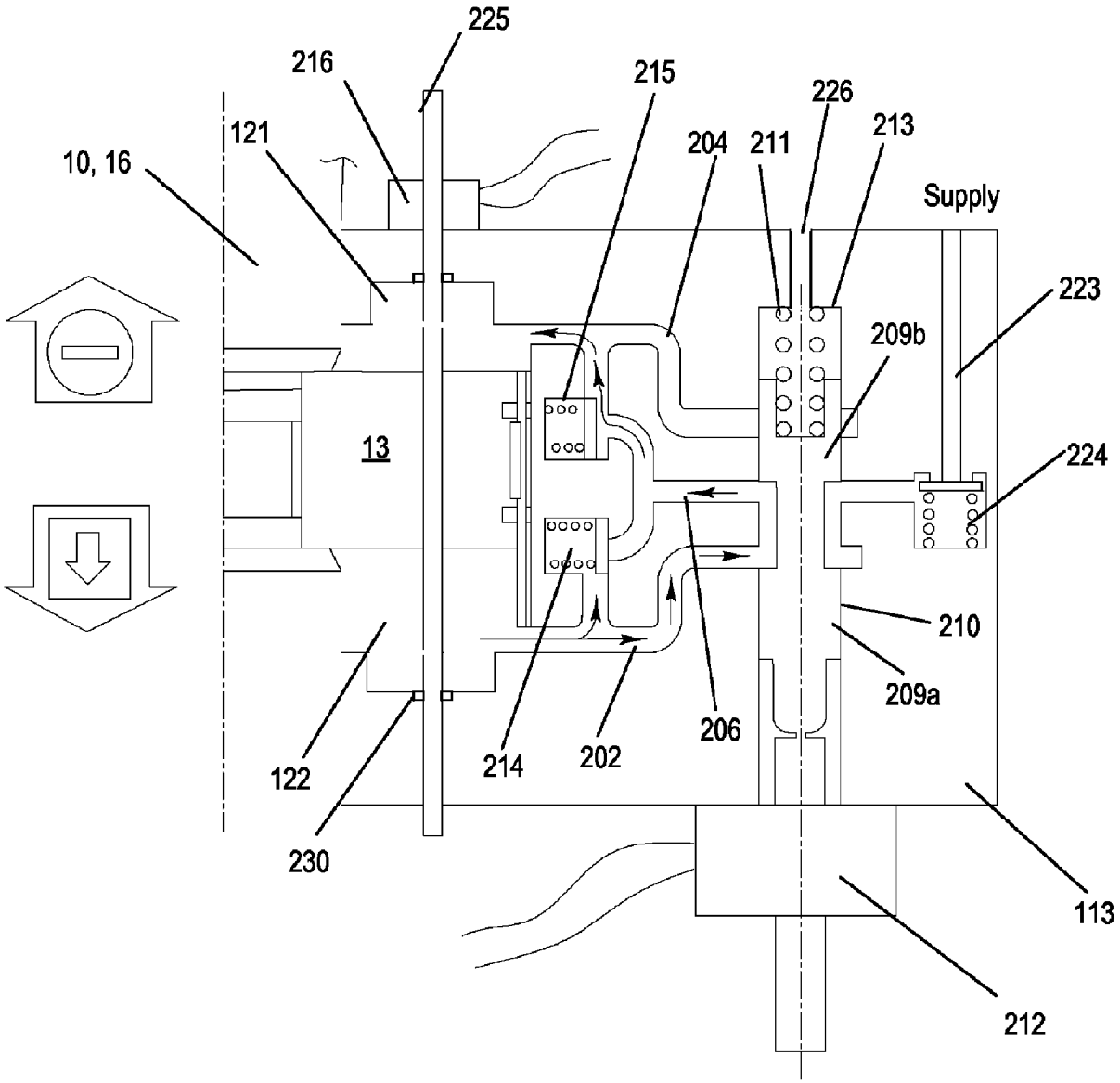
FIG. 4 shows a schematic of the control system of the present invention with the jack piston moving to a second position.
Figure 5:
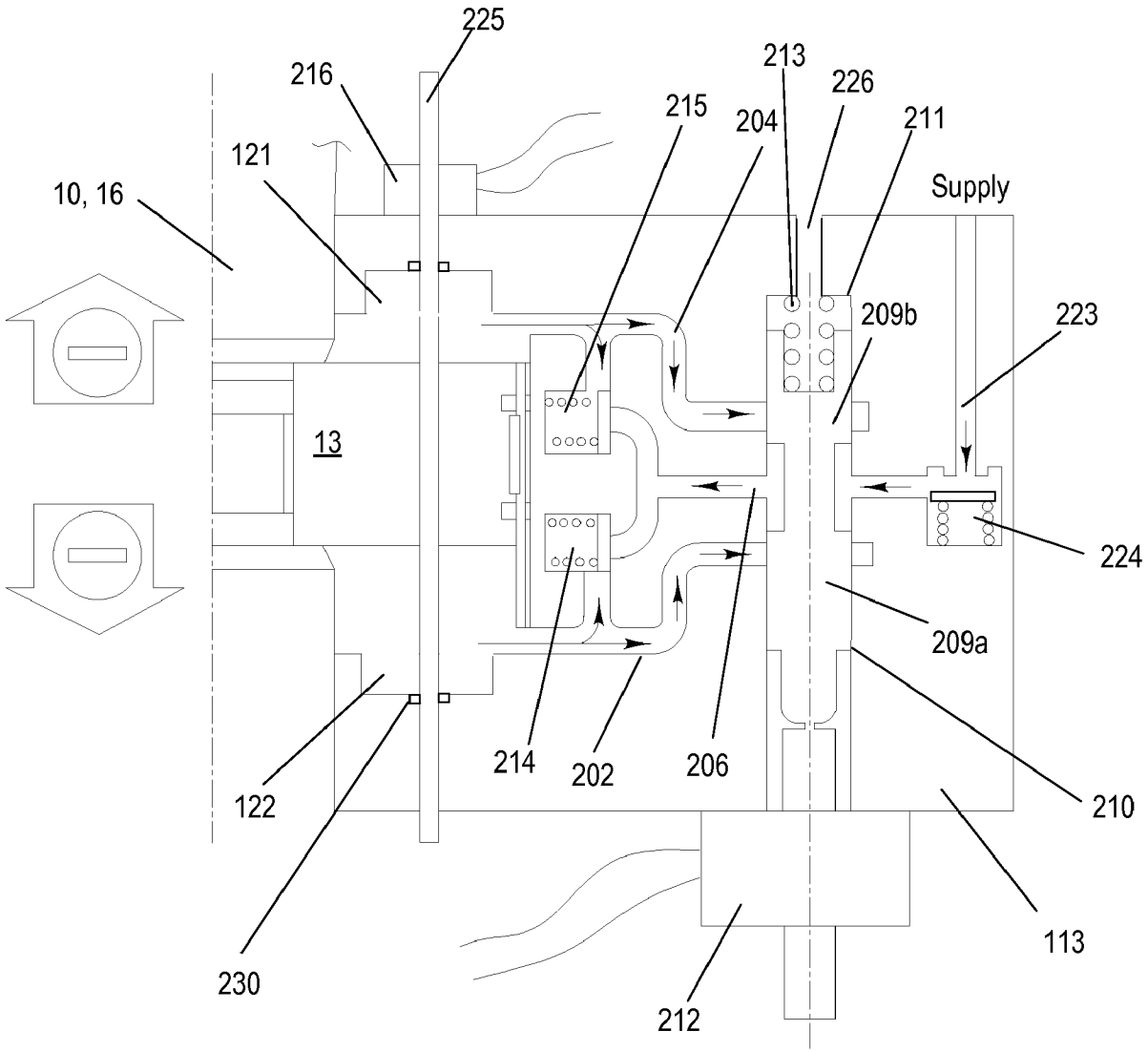
FIG. 5 shows a schematic of the control system of the present invention with the jack piston in a holding position.

FIGS. 3 through 5 show the control system of the present invention in multiple positions. The control system includes a control rack rod 225 inserted into and fixed to the jack piston 13, replacing control rod 20, valve 21, stops 130, and springs 22. On a first end of the control rack rod 225, outside of the jack head 113 is a position sensor 216. Linear reciprocating movement of the control rack rod 225 fixed to the jack piston 13 allows the position of the jack piston 13 to be measured by the position sensor 216, providing feedback to an ECU (not shown). The jack piston 13 divides a chamber formed between the jack head 113 and the control rack 7 into an upper chamber 121 and a lower chamber 122. Seals 230 between the control jack rod 225 and the fluid chambers 121 and 122 may be necessary. Movement of the jack piston 13 is further controlled by a spool valve 209. The spool valve 210 includes a spool 209 with a plurality of lands 209*a*,, 209*b*, slidably received within a bore 211 in the jack head 113. A vent 226 to atmosphere is present off of the bore 211 in the jack head 113.

The spool 209 is biased in a first direction by a spring 213 within the bore 211 and an actuator 212 in a second direction, opposite the first direction. The actuator 212 is controlled by the ECU (not shown). The ECU (not shown) receives position signals from position sensor 216, and through the actuator 212 adjusts the position of the spool 209, which in turn adjusts the jack piston 13 to a corresponding set point. The actuator 212 may be a variable force solenoid, a differential pressure control system (DPCS), regulated pressure control system (RPCS), a stepper motor, an air actuator, a vacuum actuator, a hydraulic actuator, or any type of actuator that has force or position control.

Passages 202, 204, 206, 223 are drilled into the jack head 113 allowing the flow of fluid from a main oil gallery (MOG) or supply to the spool 209 and from the spool 209 to the upper and lower chambers 121, 122. Located within the passages 206, 223 are check valves 214, 215, 224.

Referring to FIG. 3, the jack piston 13 is moving towards an up position, away from the crankshaft 9. To move towards an up position, the force of the actuator 212 on the spool 209 is greater than the force of the spring 213, moving the spool 209 until the force of the spring 213 equals the force of the actuator 212. In this position, the first land 209*a*, blocks the lower chamber passage 202 and an upper chamber passage 204 and a central passage 206 connecting to the upper and lower passages 204, 202 through check valves 215, 214 are open. Fluid in the upper chamber 121 exits the chamber through the upper chamber passage 204 and flows through the spool 209 to the central passage 206, through the lower chamber check valve 214, into the lower chamber passage 202, supplying fluid to the lower chamber 122. With fluid exiting the upper chamber 121 and entering the lower chamber 122, the jack piston 13 is moved away from the crankshaft 9. By moving the jack piston 13 away from the crankshaft 9, the control rack 7 is moved away from the crankshaft 9 and the sprocket wheel 5 is moved so that the original position of the stroke of the piston 2 in relation to the cylinder 110 is modified.

Fluid may be supplied from supply or the main oil gallery through an inlet passage 223 with a check valve 224 as necessary to makeup for leakage.

Once the desired position of the jack piston 13 is achieved, the spool valve 209 is commanded back to the null or hold position to maintain the desired position as shown in FIG. 5. The position sensor 216 mounted to the control rack rod 225 is used as feedback to the control loop to compare the actual control rack position to the desired rack position.

Referring to FIG. 4, the jack piston 13 is moving towards a down position, towards the crankshaft 9.

To move towards the down position, the force of the actuator 212 on the spool 209 is less than the force of the spring 213, and the spring 213 moves the spool 209 until the force of the actuator 212 equals the force of the spring 213 on the spool 209. In this position, the second land 209*b*, blocks the upper chamber passage 204 and the lower chamber passage 202 and the central passage 206 connected to the upper and lower passages 204, 202, through check valves 215, 214 are open. Fluid in the lower chamber 122 exits the chamber through the lower chamber passage 202 and flows through the spool 209 to central passage 206, through the upper chamber check valve 215, into the upper chamber passage 204, supplying fluid to the upper chamber 121. With fluid exiting the lower chamber 122 and entering the upper chamber 121, the jack piston 13 is moved toward the crankshaft 9. By moving the jack piston 13 towards the crankshaft 9, the control rack 7 is moved away from the crankshaft 9 and the sprocket wheel 5 is moved so that the original position of the stroke of the piston 2 in relation to the cylinder 110 is modified.

Fluid may be supplied from the MOG or supply through an inlet passage 223 with a check valve 224 as necessary to makeup for leakage.

Once the desired position of the jack piston 13 is achieved, the spool valve 209 is commanded back to the null or hold position to maintain the desired position as shown in FIG. 5. The position sensor 216 mounted to the control rack rod 225 is used as feedback to the control loop to compare the actual control rack position to the desired rack position.

FIG. 5 shows the jack piston 13 in a hold position. In this position, the force from the actuator 212 on the spool 209 equals the force on the spool 209 by the spring 213, and the spool 209 is in a position where the first land 209*a*, blocks the flow of fluid to and from the lower chamber passage 202 leading to the lower chamber 122 and the second land 209*b*, blocks the flow of fluid to and from the upper chamber passage 204 leading to the upper chamber 121. The central passage 206 is open to receiving fluid from the MOG or supply for makeup purposes only. If makeup fluid is necessary, fluid flows from the MOG through the inlet line 223 and check valve 224 to spool 209. From the spool 209, fluid flows into the central passage 206 and through the upper and lower chamber check valves 215, 214 to the upper and lower chambers 121, 122.

Figure 6:
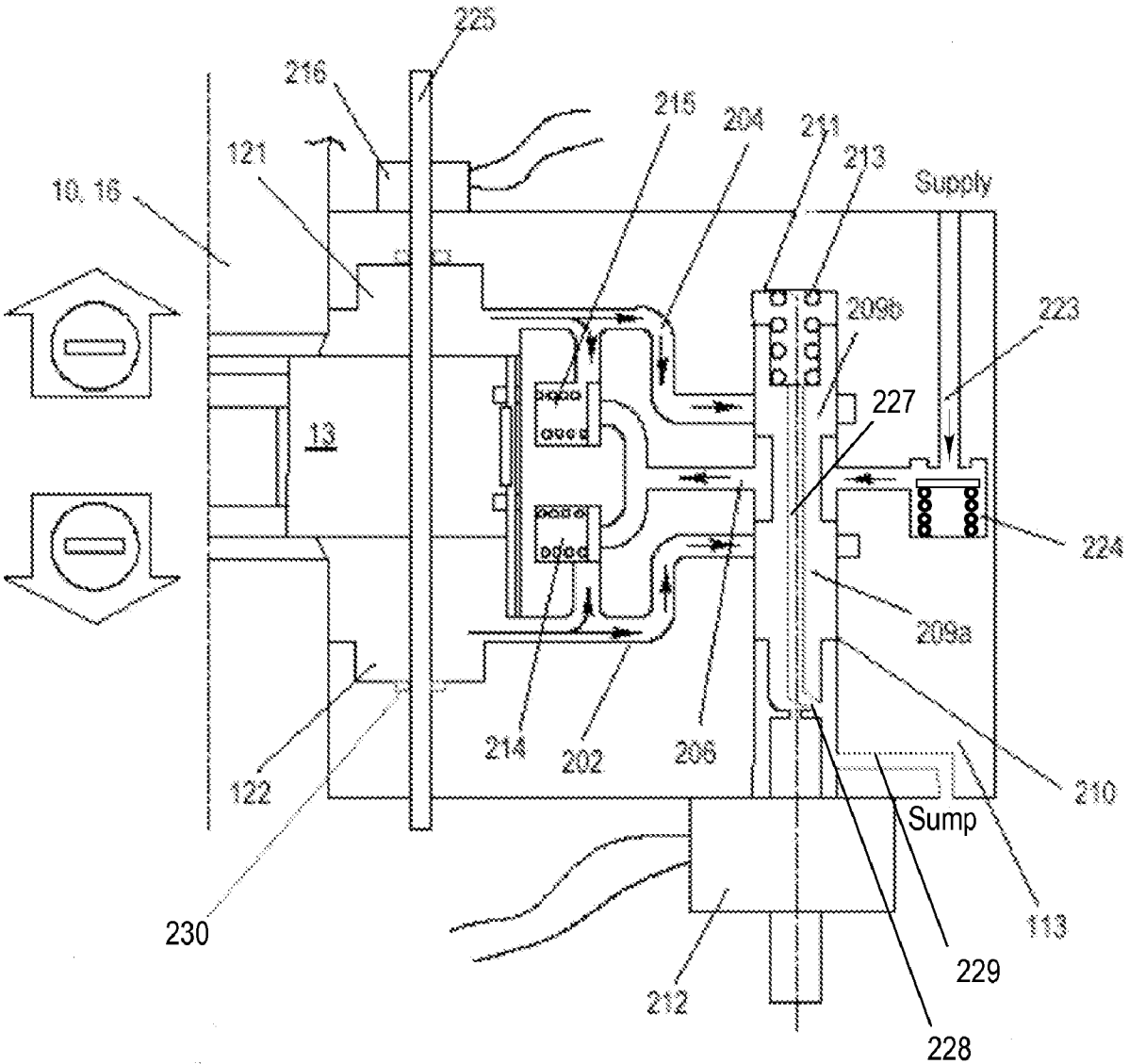
FIG. 6 shows a schematic of the control system of the present invention with the jack piston in a holding position with alternate venting.

FIG. 6 shows the jack piston in a hold position with alternate venting of the spool. A passage 227 is present that runs through the length of the spool 209 connecting the end of the bore 211 with the spring 213 to a vent 228 at the opposite end of the spool 209, which leads to sump through line 229.

Alternatively, the spool valve 210 may be replaced with any of the spool valves present in U.S. Pat. No. 7,000,580,, entitled "CONTROL VALVE WITH INTEGRATED CHECK VALVES" issued Feb. 21, 2006, and which is hereby incorporated by reference. It should be noted that if the spool valves of U.S. Pat. No. 7,000,580, are used, the check valves 214, 215, and central line 206 would be eliminated.

The actuation of the control system is shown to use torque actuation as an example, however oil pressure actuation or any other type of actuation may also be used through the control valve.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. An improved control system for an adjustment device for a variable compression ratio engine comprising: a jack head; a jack piston received within a chamber of the jack head defining a first fluid chamber and a second fluid chamber and having a first bore for receiving a jack rod and a second bore; a sprocket wheel mounted to a crankshaft and with a first set of teeth engaging a control rack fixed to the jack rod and a second set of teeth; a movable transmission member attached to a cylinder engaging the second set of teeth of the sprocket wheel, the improvement comprising:

a control rack rod received by the second bore of the chamber of the jack head a control valve for controlling the flow of fluid between the first fluid chamber and the second fluid chamber comprising a spool with a plurality of lands slidably received within a bore of the jack head;

wherein when the spool of the control valve is in a first position, fluid from the first fluid chamber exits from the first fluid chamber through the spool of the control valve to the second fluid chamber, moving the jack piston and control rack, such that the sprocket wheel undergoes a reciprocating motion, moving the cylinder to a first position;

wherein when the spool of the control valve is in a second position, fluid from the second fluid chamber exits from the second fluid chamber through the spool of the control valve to the first fluid chamber, moving the jack piston and control rack, such that the sprocket wheel undergoes a reciprocating motion, moving the cylinder to a second position; and wherein when the spool of the control valve is in a third position, fluid is provided to the first fluid chamber and the second fluid chamber only, holding or maintaining position of the jack piston within the chamber of the jack head.

2. The improved control system of claim 1, further comprising a position sensor mounted to an end of the control rack rod for measuring movement of the jack piston.

3. The improved control system of claim 1, further comprising a first fluid chamber check valve and a second fluid chamber check valve between the control valve and the first fluid chamber and the second fluid chamber.

4. The improved control system of claim 1, further comprising an actuator for controlling the position of the spool within the control valve.

5. The improved control system of claim 4, wherein the actuator is a variable force solenoid, a differential pressure control system (DPCS), a regulated pressure control system (RPCS), a stepper motor, an air actuator, a hydraulic actuator, or a vacuum actuator.

6. The improved control system of claim 1, wherein makeup fluid is supplied to the first fluid chamber and the second fluid chamber when the spool of the control valve is in the third position from an inlet line connected to supply.

7. The improved control system of claim 6, wherein the inlet line further comprises an inlet check valve.

8. An improved control system for an adjustment device for a variable compression ratio engine comprising: a jack head; a jack piston received within a chamber of the jack head defining a first fluid chamber and a second fluid chamber and having a first bore for receiving a jack rod and a second bore; a sprocket wheel mounted to a crankshaft and with a first set of teeth engaging a control rack fixed to the jack rod and a second set of teeth; a movable transmission member attached to a cylinder engaging the second set of teeth of the sprocket wheel, the improvement comprising:

a control rack rod received by the second bore of the chamber of the jack head a control valve for controlling the flow of fluid to the first fluid chamber and the second fluid chamber and from the first fluid chamber and the second fluid chamber through oil pressure actuation comprising a spool with a plurality of lands slidably received within a bore of the jack head; and an inlet supply line providing fluid to the first fluid chamber and the second fluid chamber through the control valve;

wherein when the spool of the control valve is moved to a first position, the sprocket wheel undergoes a reciprocating motion, moving the cylinder to a first position;

wherein when the spool of the control valve is moved to a second position, the sprocket wheel undergoes a reciprocating motion, moving the cylinder to a second position; and wherein when the spool of the control valve is in a third position, fluid is provided to the first fluid chamber and the second fluid chamber only, holding or maintaining position of the jack piston within the chamber of the jack head.

9. The improved control system of claim 8, further comprising a position sensor mounted to an end of the control rack rod for measuring movement of the jack piston.

10. The improved control system of claim 8, further comprising an actuator for controlling the position of the spool within the control valve.

11. The improved control system of claim 10, wherein the actuator is a variable force solenoid, a differential pressure control system (DPCS), a regulated pressure control system (RPCS), a stepper motor, an air actuator, a hydraulic actuator, or a vacuum actuator.

12. The improved control system of claim 8, wherein the inlet line further comprises an inlet check valve.

* * * * *